US010702042B2

(12) United States Patent
Shimley

(10) Patent No.: US 10,702,042 B2
(45) Date of Patent: Jul. 7, 2020

(54) APPARATUS AND METHOD FOR APPLYING COSMETIC EYEBROWS

(71) Applicant: Patsy A. Shimley, Helena, GA (US)

(72) Inventor: Patsy A. Shimley, Helena, GA (US)

( * ) Notice: Subject to any disclaimer, the term of this patent is extended or adjusted under 35 U.S.C. 154(b) by 279 days.

(21) Appl. No.: 15/817,219

(22) Filed: Nov. 19, 2017

(65) Prior Publication Data

US 2018/0092453 A1 Apr. 5, 2018

Related U.S. Application Data

(63) Continuation-in-part of application No. 14/988,795, filed on Jan. 6, 2016, now Pat. No. 9,820,553.

(60) Provisional application No. 62/175,012, filed on Jun. 12, 2015.

(51) Int. Cl.

| | |
|---|---|
| ***A45D 40/30*** | (2006.01) |
| ***A45D 40/26*** | (2006.01) |
| *A45D 24/36* | (2006.01) |

(52) U.S. Cl.

CPC ..... *A45D 40/30* (2013.01); *A45D 40/26* (2013.01); *A45D 24/36* (2013.01); *A45D 2200/1027* (2013.01); *A45D 2200/1036* (2013.01); *A45D 2200/25* (2013.01)

(58) Field of Classification Search

CPC ..... A45D 40/26; A45D 40/30; A45D 24/36; A45D 2200/1027; A45D 2200/1036; A45D 2200/25; A41G 5/02

See application file for complete search history.

(56) References Cited

U.S. PATENT DOCUMENTS

| | | | | |
|---|---|---|---|---|
| 2,998,821 | A | 9/1961 | Hurdel | |
| 3,485,251 | A | 12/1969 | Brunet | |
| 2006/0150994 | A1* | 7/2006 | Pilmanis | A45D 40/30 132/218 |
| 2013/0074868 | A1* | 3/2013 | Shimamura | A45D 34/04 132/320 |
| 2013/0263885 | A1* | 10/2013 | Sternad | A45D 40/30 132/319 |
| 2013/0337225 | A1 | 12/2013 | Beal et al. | |
| 2016/0360861 | A1 | 12/2016 | Shimley | |

* cited by examiner

*Primary Examiner* — Rachel R Steitz

(74) *Attorney, Agent, or Firm* — Asgaard Patent Services, LLC; F. Wayne Thompson, Jr.

(57) ABSTRACT

Implementations of an apparatus and method for applying cosmetic eyebrows are provided. In some implementations, the eyebrow applicator may be used to apply a cosmetic eyebrow on each brow ridge of a user. In some implementations, the eyebrow applicator may comprise a left brow applicator and a right brow applicator separated by a core ply having a window therethrough. Implementations of a cosmetic eyebrow kit used to deposit a cosmetic eyebrow onto a right brow applicator and/or a left brow applicator are provided. In some implementations, a cosmetic eyebrow kit may comprise two brow applicators, an eyebrow stencil, a container of cosmetic formula, and/or a spatula for spreading the cosmetic formula. In some implementations, a cosmetic eyebrow may be deposited on a brow applicator using the eyebrow stencil, spatula, and a portion of the cosmetic formula provided as part of the cosmetic kit.

5 Claims, 5 Drawing Sheets

APPARATUS AND METHOD FOR APPLYING COSMETIC EYEBROWS

CROSS REFERENCE TO RELATED APPLICATION

This is a continuation-in-part application claiming the benefit of U.S. patent application Ser. No. 14/988,795, filed on Jan. 6, 2016, which claims the benefit of U.S. Provisional Application Ser. No. 62/175,012, filed on Jun. 12, 2015, the entities of both applications are incorporated herein by reference in their entirety.

TECHNICAL FIELD

This disclosure relates to implementations of an apparatus and method for applying cosmetic compositions to the body. More specifically, the present invention relates to an apparatus and method for applying cosmetic eyebrows to the face of a user, specifically, the supraorbital ridges of the user.

BACKGROUND

In many ways, the overall appearance of an eyebrow is affected by its arch, length, and thickness. Hair loss or sparse hair on the eyebrow may occur for many reasons (e.g., chemotherapy) and thereby leave a person with unaesthetic eyebrows. Methods of creating an aesthetically pleasing eyebrow having generally included the removal of unwanted hair or the filling in of a sparse and/or lightly colored eyebrow.

Various products have been designed to fill-in or recreate an eyebrow. Example products include brown powder, eyebrow pencils, and eyebrow gels. The goal of these products is not only to fill-in an eyebrow, or the complete recreation of an eyebrow when needed, but also to create a bilateral symmetry between a user's eyebrows such that the eyebrows have the same visual characteristics (e.g., shape, thickness, size, and/or relative position on the supraorbital ridge). However, the previously mentioned products have several drawbacks. First, the ability to create two eyebrows having the same visual characteristics is limited by the user's manual dexterity and artistic abilities. Second, proper positioning of an eyebrow on the supraorbital ridge requires trial and error since no method of ascertaining a suitable location prior to application is provided for. Third, the desirability of a particular color or shape of an eyebrow cannot be determined until the cosmetic eyebrow is applied to the user's brow ridge.

Thus, there is a need for an apparatus and method for applying cosmetic eyebrows that enables for the selection of a desired shape, color, and size prior to application. Further, there is a need for an apparatus and method for applying cosmetic eyebrows that allows for the proper positioning of the cosmetic eyebrow prior to application on the brow ridge of a user.

SUMMARY OF THE INVENTION

Implementations of an eyebrow applicator are provided. The eyebrow applicator may comprise a laminate structure having a left brow applicator, a right brow applicator, and a core ply positioned therebetween. The core ply is used to separate and thereby prevent contact between the left and right brow applicators. In some implementations, the core ply comprises a first side, a second side, and a centrally located window. In some implementations, the left and right brow applicators may each comprise a clear polymer film having a cosmetic formula deposited on an interiorly-facing surface thereof. The cosmetic formula is positioned on each brow applicator so that when the brow applicators are secured to the core ply the cosmetic formula is located within the window of the core ply. In this way, the cosmetic formula is protected from inadvertent contact and smudging. In some implementations, the core ply may include an adhesive on the first side and the second side used to removably secure the left and right brow applicators thereto.

A method of applying cosmetic eyebrows using the eyebrow applicator described herein is provided. Initially, after selecting a desired cosmetic eyebrow, a user applies the cosmetic eyebrow by peeling off a left or right brow applicator from the core ply of the eyebrow applicator. Then, the user positions the cosmetic eyebrow over a desired placement site on their brow ridge by virtue of the clear polymer film. The clear polymer film allows the user to ascertain a desired placement location for the cosmetic eyebrow prior to its application on the brow ridge. Next, the user presses the selected eyebrow applicator to their brow ridge. In this way, a portion of the cosmetic formula deposited on the brow applicator may be deposited at the desired placement location on the user's skin. Then, the user may blot the cosmetic formula deposited on their skin with absorbent material, such as a tissue or other absorbent material.

In some implementations, the method of applying cosmetic eyebrows may further comprise, selecting a desired cosmetic eyebrow from a selection of cosmetic eyebrows of varying size, shape, and/or color. The selection of a cosmetic eyebrow may be made in context of a user's brow ridge by using the window of the eyebrow applicator, or the look and appeal of the eyebrow, to make an initial selection. By using the window of the applicator, the user may ascertain if the selected cosmetic eyebrow would be aesthetically pleasing if applied. Then, if the selected cosmetic eyebrow is undesirable to the user, another size, shape, and/or color of cosmetic eyebrow may be examined and selected for use.

The present invention provides for the convenient, easy, and direct application of cosmetics, such as a cosmetic eyebrow, to a brow ridge of a user. The eyebrow applicator is compact and configured to substantially minimize the possibility of smudging the cosmetic formula deposited on the brow applicators. Smudging of the cosmetic formula is minimized due to the construction of the eyebrow applicator. Further, the present invention, through the use of clear brow applicators, allows a user to select a location to place each cosmetic eyebrow before applying the cosmetic formula to their brow ridge. In some implementations, the eyebrow applicator includes a reusable adhesive on the first and/or second sides of the core ply so that the brow applicators may be removably secured thereto. In some implementations, each brow applicator includes sufficient cosmetic formula thereon to enable multiple applications thereof.

Implementations of a cosmetic eyebrow kit used to deposit a cosmetic eyebrow onto a right brow applicator and/or a left brow applicator are provided. In some implementations, when provided as part of a cosmetic eyebrow kit, the brow applicators may be clean (i.e., no cosmetic formula shaped like an eyebrow has been deposited thereon). In this way, a cosmetic eyebrow having the shape and/or color preferred by the user may be deposited thereon. In some implementations, the cosmetic eyebrow kit may be used to replace a cosmetic eyebrow previously deposited on a brow applicator with a new cosmetic eyebrow having the shape and/or color preferred by the user.

In some implementations, a cosmetic eyebrow kit may comprise two brow applicators, an eyebrow stencil, a container of cosmetic formula, and/or a spatula for spreading the cosmetic formula. In some implementations, a cosmetic eyebrow may be deposited on a brow applicator using the eyebrow stencil, spatula, and a portion of the cosmetic formula provided as part of the cosmetic kit.

DETAILED DESCRIPTION

Figure 1:
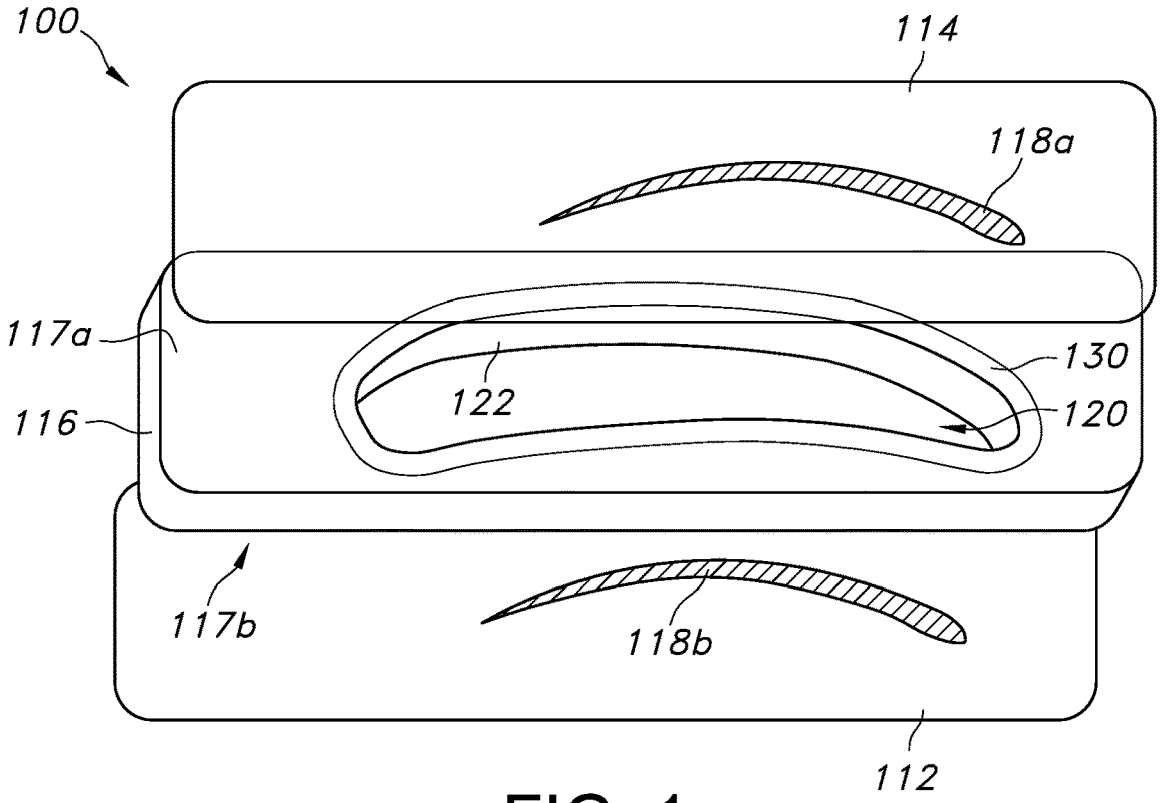
FIG. 1 illustrates an exploded view of an example eyebrow applicator according to the principles of the present disclosure.
Figure 2:
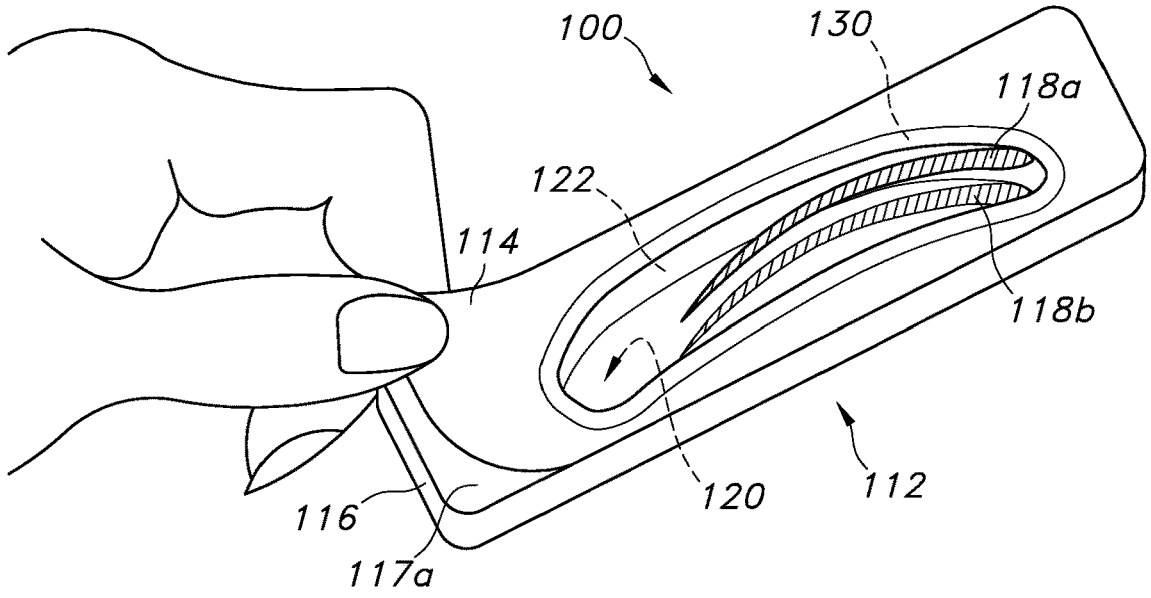
FIG. 2 illustrates an example implementation of the eyebrow applicator shown in FIG. 1.

FIGS. 1 and 2 illustrate an example implementation of an eyebrow applicator 100 according to the principles of the present disclosure. In some implementations, the eyebrow applicator 100 may be used to apply a cosmetic eyebrow on each brow ridge of a user. In some implementations, the eyebrow applicator 100 is compact and may provide thereon cosmetic eyebrows of varying shape, color, and/or size. In some implementations, the eyebrow applicator 100 provides for the convenient, easy, and/or direct application of cosmetic eyebrows to a user's face.

In some implementations, as shown in FIG. 1, the eyebrow applicator may comprise a left brow applicator 112 and a right brow applicator 114 separated by a core ply 116. In some implementations, the right brow applicator 114 and the left brow applicator 112 may be removably secured to the first side 117*a* and the second side 117*b*, respectively, of the core ply 116 (see, e.g., FIGS. 1 and 2). In this way, the eyebrow applicator 100 has a laminate structure. In some implementations, a cosmetic formula 118*a* and 118*b* shaped like an eyebrow may be deposited on the right brow applicator 114 and the left brow applicator 112, respectively (see, e.g., FIG. 1).

As shown in FIG. 2, in some implementations, the shape of the left brow applicator 112 and right brow applicator 114 may generally correspond to the shape of the core ply 116. In some implementations, the left brow applicator 112 and right brow applicator 114 may have a generally rectangular shape (see, e.g., FIG. 1). In some implementations, the left brow applicator 112 and right brow applicator 114 may have the general shape of an oval, circle, square, and/or other irregular shape. In some implementations, the left brow applicator 112 and right brow applicator 114 may be shaped differently than the core ply 116.

In some implementations, both the left brow applicator 112 and right brow applicator 114 are made of a clear polymer film. In some implementations, the clear polymer film may have a thickness ranging between 0.001 inch to 0.02 inch, inclusive of 0.001" (inch) and 0.002" (inch). In some implementations, the thickness of the clear polymer film may be up to 0.003" (inch) thick. In some implementations, the left brow applicator 112 and right brow applicator 114 may be made of a polyester film, for example, polyethylene terephthalate (PET). In some implementations, the left brow applicator 112 and right brow applicator 114 may be made of any suitable clear polymer film (e.g., polyesters, polypropylenes, polyethylenes).

As shown in FIGS. 1 and 2, in some implementations, the cosmetic formula 118*a*, 118*b* may be deposited on or near the longitudinal axis of the right brow applicator 114 and left brow applicator 112, respectively. In some implementations, a surface of each brow applicator 112, 114 may be pretreated and/or coated to facilitate the placement of the cosmetic formula 118*a*, 118*b* thereon.

In some implementations, the cosmetic formula 118*a*, 118*b* may be deposited on the right brow application 114 and the left brow applicator 112, respectively, by any printing method known to one of ordinary skill in the art. Example printing methods include, but are not limited to, screen printing, pad printing, flexographic, letter press, and/or ink jet printing.

In some implementations, a chemical pretreatment (e.g., acrylic co-polyester, urethane, and/or microcrystalline wax) may be used on the surface of the clear polymer film of the brow applicators 114, 112 to facilitate printing (or adhering) the cosmetic formula 118*a*, 118*b* thereon. In some implementations, the thickness of the acrylic co-polyester and/or urethane coating may be up to 4 microns thick. In implementations where microcrystalline wax is used, the microcrystalline wax used possesses absorbent properties. In some implementations, the use of the chemical pretreatment may be limited to the area of the clear polymer film of each brow applicator 114, 112 where the cosmetic formula 118*a*, 118*b* is deposited.

In some implementations, a release agent (or de-moulding agent) (e.g., silicone) may be applied to the brow applicators 114, 112 to thereby control and/or facilitate their removal from the core ply 116. In some implementations, the release agent may be used to minimize or prevent the appearance of an adhesive on the brow applicators 114, 112 after their separation from the core ply 116. In some implementations, the release agent may be used to prevent the brow applicators 114, 112 from bonding to the core ply 116. The release agent may be pattern printed onto the brow applicators 114, 112 by methods known to one of ordinary skill in the art. In some implementations, a release agent may not be applied to the brow applicators 114, 112.

In some implementations, the brow applicators 114, 112 may include various indicia thereon (e.g., company name(s), logos, etc. . . . ).

As shown in FIG. 1, in some implementations, the cosmetic formula 118*a*, 118*b* may be deposited on each brow applicator 114, 112 in the shape of an eyebrow. In this way, a cosmetic eyebrow is formed on each brow applicator 114, 112. In some implementations, the cosmetic formula 118*a*, 118*b* may be deposited on each brow applicator 114, 112 in any number of patterns and/or shapes that may resemble an eyebrow. In some implementations, the cosmetic formula 118*a*, 118*b* may be deposited onto each brow applicator 114, 112 in an amorphous state. In some implementations, the cosmetic formula 118*a*, 118*b* may be deposited on the brow applicators 114, 112 in any number of patterns or shapes.

In some implementations, the cosmetic formula 118*a*, 118*b* may comprise a uniform mixture of cosmetic waxes, oils, pigments, and/or emollients. In some implementations, the cosmetic formula 118*a*, 118*b* is a mixture of wax (e.g., microcrystalline wax) and oils used to initially create a soft amorphous composition. The wax is used to provide structure to the composition. In some implementations, pigments and/or dyes may be used to color the composition. In some implementations, the composition used to create the cosmetic formula 118*a*, 118*b* is not subjected to heat during preparation. In this way, the composition may be prevented from hardening. In some implementations, the composition used to create the cosmetic formula 118*a*, 118*b* may be similar (e.g., include similar percentages of waxes and/or oils) to a composition formulation used to make lipstick.

As shown in FIGS. 1 and 2, in some implementations, the core ply 116 may have a generally rectangular shape. In some implementations, the shape of the core ply 116 may correspond to the shape of the left and right brow applicators 112, 114 (see, e.g., FIG. 2). In some implementations, the first side 117*a* and the second side 117*b* of the core ply 116 are parallel or substantially parallel to each other (see, e.g., FIG. 1). In some implementations, the core ply 116 may have the general shape of an oval, circle, square, and/or other irregular shape. In some implementations, the shape of the core ply 116 may not correspond to the shape of the left and right brow applicators 112, 114.

In some implementations, the core ply 116 may have a thickness ranging from 0.05" inch to 0.25" inch, inclusive of 0.05" (inch) to 0.25" (inch). In some implementations, the core ply 116 may be made of paperboard, rigid and/or flexible polymer foams (e.g., polyvinyl chloride (PVC), ethyl vinyl acetate (EVA)), injection molded and/or thermoformed plastics, corrugated paper board, and/or plastic, or a combination thereof. In one implementation, the core ply 116 is rigid polystyrene foam that is approximately 0.15" (inch) thick. In some implementations, the core ply 116 is made from foam and the first side 117*a* and the second side 117*b* thereof may be laminated with a foil-coated paper. Such lamination may be utilized for decorative effect, to add rigidity to the core ply 116, and/or to increase the overall thickness of the core ply 116. Increasing the rigidity of the core ply 116 is especially important if the core ply 116 is made of a softer foam.

As shown in FIG. 1, in some implementations, the first side 117*a* and the second side 117*b* of the core ply 117 may have an adhesive 130 thereon. The adhesive 130 on the core ply allows for the attachment and removal of the right brow 114 and left brow 112 applicators. In some implementations, the adhesive 130 may only be deposited on the portion of the first side 117*a* and the second side 117*b* of the core ply 116 adjacent the interior edge 122 of the window 120 (see, e.g., FIG. 2). In this way, at least a portion of the core ply 116 in contact with each brow applicator 114, 112 is devoid of adhesive 130 thereby allowing for the easy removal of each brow applicator 114, 112 (see, e.g., FIG. 2).

As shown in FIG. 2, in some implementations, the adhesive 130 used on the first side 117*a* and second side 117*b* of the core ply 116 may be a pressure sensitive adhesive. In this way, the right brow 114 and the left brow 112 applicators may be removably secured to the core ply 116 multiple times. One of ordinary skill in the art having the benefit of the present disclosure would know how to select an appropriate adhesive 130 to use with the eyebrow applicator 100.

In some implementations, the adhesive 130 may be printed on the core ply 116 using any printing method known to one of ordinary skill in the art. Example printing methods include, but are not limited to, screen printing, pad printing, flexographic, letter press, and/or ink jet printing. In some implementations, the adhesive 130 may be pattern printed onto the core ply 116 (see, e.g., FIG. 2). In some implementations, a release agent negates the adhesive properties of the adhesive 130 on the area outside of the pattern printed area of the core ply 116. In this way, the appearance of the adhesive 130 on the brow applicators 114, 112 after removal from the core ply 116 may be minimized or prevented.

As shown in FIG. 1, in some implementations, the core ply 116 may further comprise a die-cut aperture forming a window 120 therethrough. In some implementations, the window 120 may be positioned in the central region of the core ply 116 (see, e.g., FIG. 2). In some implementations, the window 120 may not be positioned in the central region of the core ply 116. In some implementations, the window 120 of the core ply 116 has an arch shape (see, e.g., FIG. 1). In some implementations, the arch shape of the window 120 emulates the curve of an eyebrow. In some implementations, the window 120 of the core ply 116 may be any suitable shape. The window 120 of the core ply 116 is larger (or wider) than the area defined by the cosmetic formula 118*a*, 118*b* deposited on the right brow 114 and left brow 112 applicators (see, e.g., FIG. 2). In this way, the cosmetic formula 118*a*, 118*b* is prevented from making contact with the interior edge 122 of the window 120 and being disrupted thereby (see, e.g., FIG. 2).

As shown in FIG. 2, in some implementations, the width of the window 120 opening is sized to provide a minimum of 0.125" (inch) of clearance between all sides of the deposited cosmetic formula 118*a*, 118*b* and the interior edge 122 of the window 120. In some implementations, the interior edge 122 of the window 120 may provide more than, or less than, 0.125" (inch) of clearance between all sides of the deposited cosmetic formula 118*a*, 118*b* and the interior edge 122 of the window 120.

As shown in FIG. 2, in some implementations, the window 120 enables a clear or substantially clear line of sight through the core ply 116 even when the right brow 114 and/or the left brow 112 applicators are secured to the first side 117*a*, and the second side 117*b*, respectively, of the core ply 116. In some implementations, the right brow 114 and the left brow 112 applicators may be positioned on the assembled eyebrow applicator 100 in a mirrored fashion, separated by the core ply 116 (see, e.g., FIG. 2). In some implementations, the right brow 114 and the left brow 112 applicators may be positioned on the assembled eyebrow applicator 100 so that the side of each brow applicator 114, 112 having the cosmetic formula 118*a*, 118*b* thereon is secured to the core ply 116 and the cosmetic formula 118*a*, 118*b* is thereby positioned within the window 120 (see, e.g., FIG. 2). In this way, the brow applicators 114, 112 are kept separated thereby preventing smudging and/or smearing of the cosmetic formula 118*a*, 118*b* thereon (see, e.g., FIG. 2).

As shown in FIG. 2, in some implementations, the assembled eyebrow applicator 100 comprises a right brow applicator 114 and a left brow applicator 112 separated by a core ply 116, as described above. The right brow applicator 114 and the left brow applicator 112 are removably secured to the first side 117*a* and the second side 117*b*, respectively, of the core ply 116 through the use of an adhesive 130. The cosmetic formula 118*a*, 118*b* is deposited on the side of each brow applicator 114, 112 that is removably secured to the core ply 116. As a result of the window 120 through the core ply 116, the cosmetic formula 118*a*, 118*b* is substantially devoid of contact with any surface other than the brow applicator 114, 112 to which it's secured. Further, the thickness of the core ply 116, and thereby the depth of the window 120, prevents the cosmetic formula 118*a*, 118*b* deposited on each brow applicator 114, 112 from contacting the other.

In some implementations, the assembled eyebrow applicator 100 is pliable, which may be the result of the material used to make the core ply 116 and/or the brow applicators 114, 112. In this way, the eyebrow applicator 100 may accommodate (or conform to) the natural curvature of a user's brow ridge when it is pressed there against to simulate how the cosmetic eyebrow would look once applied.

In some implementations, the clear polymer film of each brow applicator 114, 112 aids in placing the cosmetic eyebrows 118*a*, 118*b* onto a desired location, creating symmetrical eyebrows, and/or eliminating guesswork about brow shaping.

Figure 3:
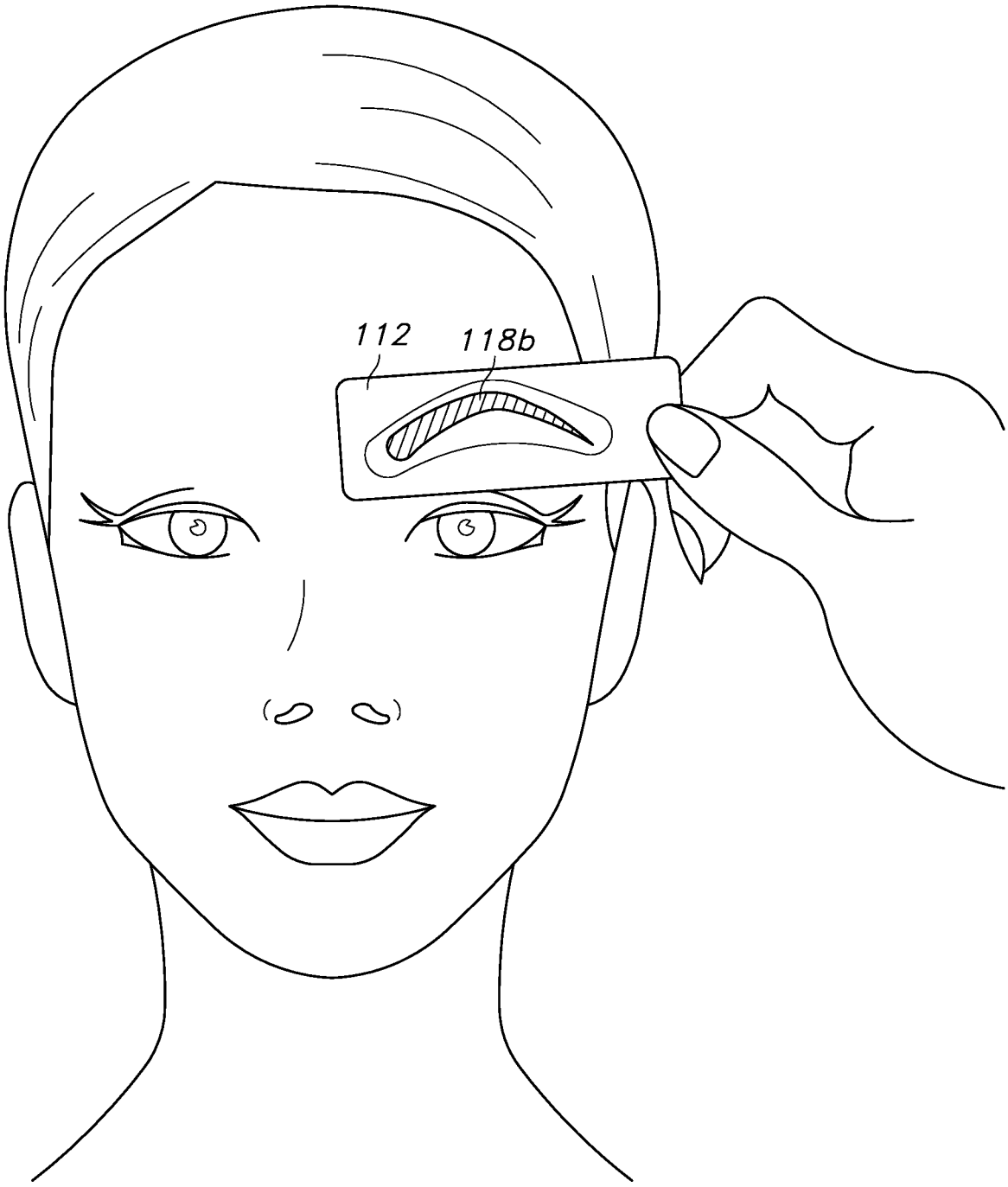
FIG. 3 illustrates the selection of a placement location of a cosmetic eyebrow using an implementation of the eyebrow applicator of the present disclosure.
Figure 4:
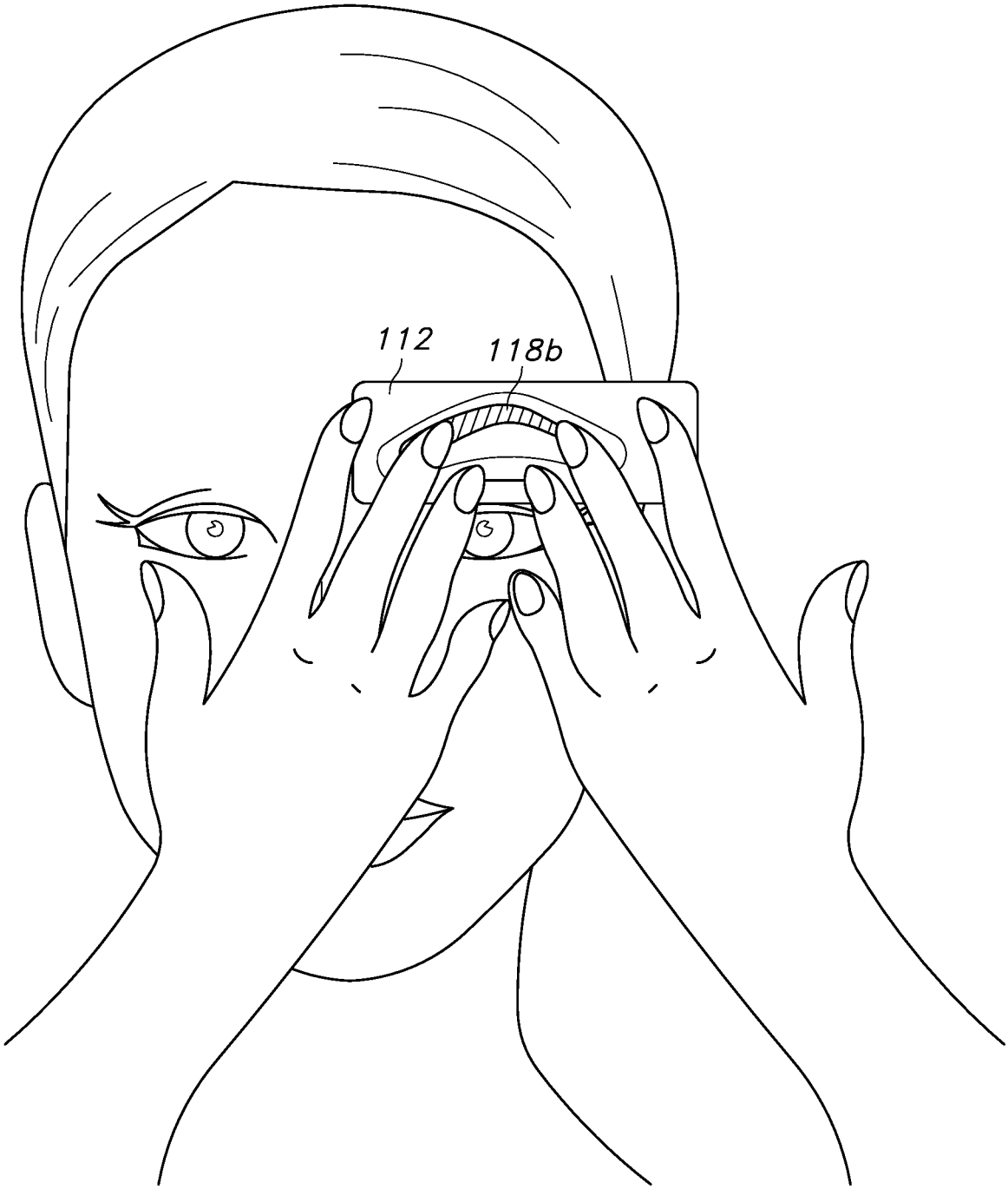
FIG. 4 illustrates the application of a cosmetic eyebrow using an eyebrow applicator constructed in accordance with the present disclosure.

As shown in FIGS. 3 and 4, in some implementations, a method of applying cosmetic eyebrows using the eyebrow applicator 100 is provided.

In some implementations, an eyebrow applicator 100 having the desired cosmetic eyebrows thereon is initially selected by the user.

Then, the left brow applicator 112 is peeled off of the core ply 116 of the eyebrow applicator 100 (see, e.g., FIG. 2 which shows the right brow applicator 114 being peeled off of the core ply 116).

Next, as shown in FIG. 3, aligning the left brow applicator 112 over a desired placement site on the user's brow ridge using the clear polymer film. In this way, the clear polymer film allows the applicator 112 to facilitate visually referencing the placement of the cosmetic eyebrow prior to application on the user's skin.

Then, as shown in FIG. 4, pressing the left brow applicator 112 against the user's brow ridge thereby depositing at least a portion of the cosmetic formula 118*b* thereon. In this way, a cosmetic eyebrow is placed on the skin of the user's brow ridge.

Next, in some implementations, blotting the cosmetic formula 118*b* deposited on the user's skin with an absorbent material (e.g., tissue). In this way, excess liquids such as oils may be absorbed out of the cosmetic formula 118*b* thereby causing the remaining cosmetic formula to more effectively adhere to the skin and/or hair of a user.

Then, the above steps may be repeated in order to apply the cosmetic eyebrow 118*a* on the right brow applicator 114 to the user's right brow ridge.

In some implementations, the method of applying cosmetic eyebrows using an eyebrow applicator 100 may further comprise the steps of, initially selecting an eyebrow applicator 100 having a desired cosmetic eyebrow thereon from a selection of cosmetic eyebrows of varying size, shape, and/or color.

Then, placing the eyebrow applicator 100 over a portion of the user's eyebrow ridge and viewing the brow ridge and cosmetic eyebrow through the window 120 of the eyebrow applicator 100. In this way, the cosmetic eyebrow may be selected in context of the user's brow ridge thereby allowing the look and appeal of the selected cosmetic eyebrow to be ascertained prior to its application to the skin. If the cosmetic eyebrow is found not desirable to the user, another eyebrow applicator 100 (and thereby cosmetic eyebrows) is selected and the process repeated.

In some implementations, slight contact on the side of the brow applicator 114, 112 free of cosmetic formula 118*a*, 118*b* is all that is needed to deposit a portion of the cosmetic formula 118*a*, 118*b* on the skin and/or hair of a user.

In some implementations, the eyebrow applicator 100 may be multi-use such that the application of the cosmetic eyebrows 118*a*, 118*b* provided thereby can be repeated using the same brow applicators 114, 112. In some implementations, there may be a sufficient amount of cosmetic formula 118*a*, 118*b* applied to the brow applicators 114, 112, respectively, to allow each brow applicator to be used three to five times. In some implementations, there may be an amount of cosmetic formula 118*a*, 118*b* applied to each brow applicator 114, 112, respectively, to allow each brow applicator to be used less than three times or more than five times.

Initially, in some implementations, an array of windows 120 may be cut from a single piece of material using a die-cutting process. Next, in some implementations, an array of core ply 116 may be cut from a single sheet of material using a die-cutting process. In some implementations, to minimize the risk of the brow applicators 114,112 touching one another during the die-cutting process which is used to cut out each core ply 116, the ejector pads used to position the die of a die-cutting machine used to form the window 120 of the core ply 116 are removed. In this way, pressures from the die cutting procedure which could force the brow applicators 114, 112 to contact one another are removed.

In addition to the above described implementations of the eyebrow applicator 100 and its method of use, other implementations of the eyebrow applicator are envisioned. In one additional implementation, the cosmetic formula is deposited on each brow applicator in various patterns so that when the cosmetic formula is applied to a user's brow ridge a template or pattern is left behind. In this way, a user may see which hairs are outside of the provided template or pattern and then remove them (e.g., pluck or trim the hairs) to leave behind an eyebrow having the shape of the pattern or template. In this implementation, the cosmetic formula may be brightly colored so that hairs not so colored may be easily spotted and plucked or trimmed. In this way, the cosmetic formula provides guidance to the user so they can conform their brows to a desired shape. After the hair is removed, the cosmetic formula is removed leaving behind an eyebrow having the desired shape.

In another implementation of the present invention, the cosmetic formula is deposited on each brow applicator in a pattern that only defines the outline of a desired brow shape or only a portion thereof. Or, in other words, the shape of the cosmetic formula on each applicator defines an area (or void) where eyebrow hair is not desired. In some implementations, the cosmetic formula may be a wax material. When using an eyebrow applicator having a wax pattern thereon, the eyebrow applicator may be heated (e.g., by a microwave) to soften and activate the wax. Then, the softened, patterned wax may be applied to the user's brow ridge. In this way, the wax may adhere to the hairs desired to be removed and not to the hairs the user's desires to retain. Once the deposited, patterned wax has cooled, the deposited, patterned wax is removed. In this way, the unwanted hair is removed leaving behind a shapely eyebrow.

In keeping with the spirit of the present invention, the eyebrow applicator may be adapted to apply other decorative cosmetic art and/or body art. For example, the cosmetic formula may be used to create multi-color art. Also, glitter, and/or shimmer could be added to the cosmetic formula. Like the above-described cosmetic formula, these implementations of the cosmetic formula may become more fixed to the skin through blotting.

Figure 5:
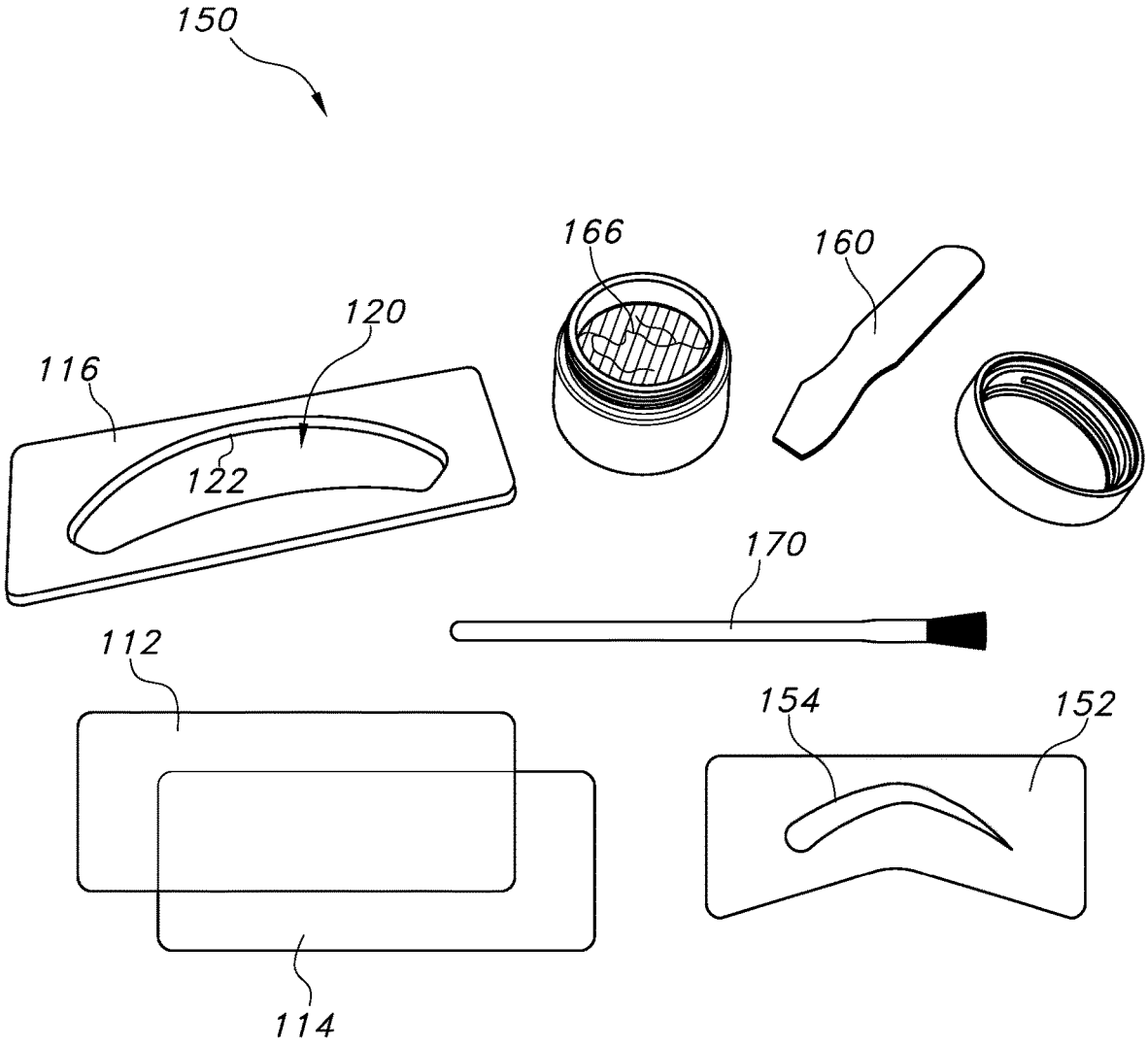
FIG. 5 illustrates an example cosmetic eyebrow kit according to the principles of the present disclosure.

FIG. 5 illustrates an example implementation of a cosmetic eyebrow kit 150 used to deposit a cosmetic eyebrow 118*a*, 118*b* onto a right brow applicator 114 and/or a left brow applicator 112. In some implementations, when provided as part of a cosmetic eyebrow kit 150, the brow applicators 114, 112 may be clean (i.e., no cosmetic formula shaped like an eyebrow has been deposited thereon). In this way, a cosmetic eyebrow 118*a*, 118*b* having the shape and/or color preferred by the user may be deposited thereon. In some implementations, the cosmetic eyebrow kit 150 may be used to replace a cosmetic eyebrow previously deposited on a brow applicator 114, 112 with a new cosmetic eyebrow 118*a*, 118*b* having the shape and/or color preferred by the user.

As shown in FIG. 5, in some implementations, a cosmetic eyebrow kit 150 may comprise two brow applicators 112, 114, an eyebrow stencil 152, a container of cosmetic formula 166, and/or a spatula 160 for spreading the cosmetic formula. In some implementations, a cosmetic eyebrow 118*a*, 118*b* may be deposited on a brow applicator 114, 112 using the eyebrow stencil 152, spatula 160, and a portion of the cosmetic formula 166 (see, e.g., FIGS. 6-8).

In some implementations, the brow applicators 114, 112 provided with a cosmetic eyebrow kit 150 may be the same as, or similar to, the right brow applicator 114 and/or the left brow applicator 112 described above.

As shown in FIG. 5, in some implementations, an eyebrow stencil 152 may include an eyebrow shaped aperture 154 that extends therethrough. In this way, the eyebrow stencil may be used to deposit cosmetic formula 166 in the shape of an eyebrow 118*a*, 118*b* on a brow applicator 114, 112 (see, e.g., FIGS. 7 and 8). In some implementations, the aperture 154 of the eyebrow stencil 154 may be any shape, or combination of shapes, suitable for depositing a cosmetic eyebrow 118*a*, 118*b* on a brow applicator 114, 112.

As shown in FIG. 5, the aperture 154 of the eyebrow stencil 152 is oriented to form a cosmetic eyebrow 118*a* for use above the user's right eye. It should be understood that the eyebrow stencil 152 may be flipped over so that the aperture 154 may be used to form a cosmetic eyebrow 118*b* for use above the user's left eye. In some implementations, each side of an eyebrow stencil 152 may be labeled so that the user can easily identify where a cosmetic eyebrow 118*a*, 118*b* formed by that particular orientation of the eyebrow stencil 152 should be positioned on their brow ridge. In some implementations, the eyebrow stencil 152 may not be labeled.

In some implementations, the eyebrow stencil 152 may be configured to position a cosmetic eyebrow 118*a*, 118*b*, formed by filling in the eyebrow aperture 154 thereof with cosmetic formula 166, on or near the longitudinal axis of a brow applicator 114, 112.

In some implementations, the eyebrow stencil 154 may be made of a clear polymer film. In some implementations, the polymer film may have a thickness ranging between 0.001 inch to 0.02 inch, inclusive of 0.001" (inch) and 0.002" (inch). In some implementations, the thickness of the polymer film may be up to 0.003" (inch) thick. In some implementations, the eyebrow stencil 154 may be made of a polyester film, for example, polyethylene terephthalate (PET). In some implementations, the eyebrow stencil 154 may be made of any suitable polymer film (e.g., polyesters, polypropylenes, polyethylenes).

In some implementations, the cosmetic formula 166 may be provided in a resealable container 167. In some implementations, the cosmetic formula 166 may comprise a uniform mixture of cosmetic waxes, oils, pigments, and/or emollients. In some implementations, the cosmetic formula 166 may be a mixture of wax (e.g., microcrystalline wax) and oils used to initially create a soft amorphous composition. The wax is used to provide structure to the composition. In some implementations, pigments and/or dyes may be used to color the composition. In some implementations, the composition used to create the cosmetic formula 166 is not subjected to heat during preparation. In this way, the composition may be prevented from hardening. In some implementations, the composition used to create the cosmetic formula 166 may be similar to a composition formulation used to make lipstick (e.g., include similar percentages of waxes and/or oils).

Figure 7:
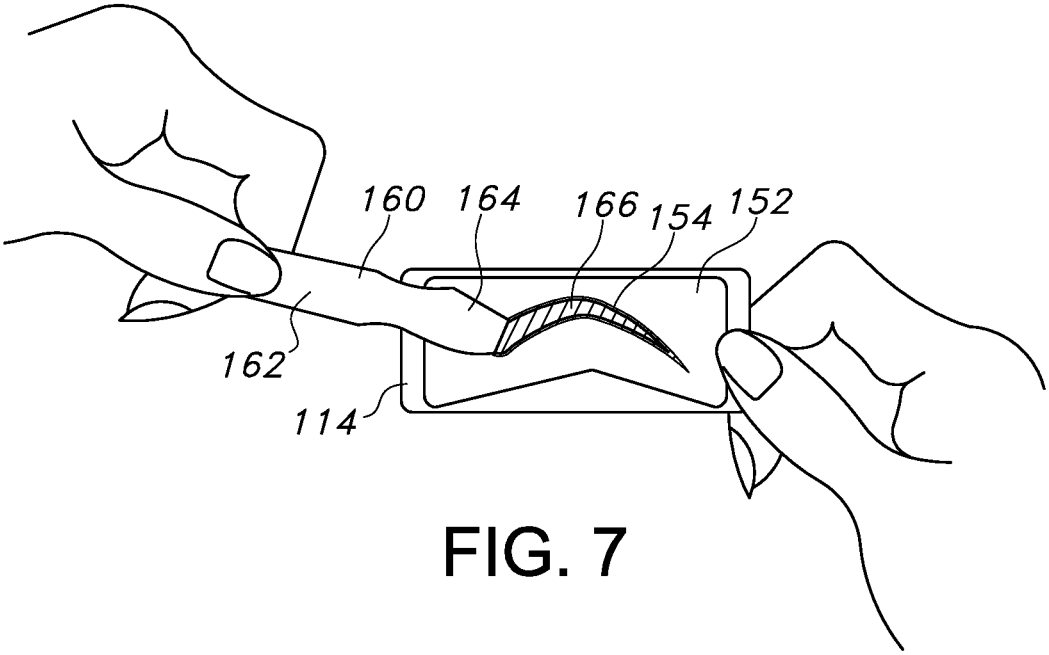

In some implementations, the spatula 160 may be configured to extract a portion of the cosmetic formula 166 from its container and/or spread the cosmetic formula 166 within the aperture 154 of the stencil 152 (see, e.g., FIG. 7). In this way, a cosmetic eyebrow 118*a*, 118*b* having the shape and/or color preferred by the user may be deposited on a brow applicator 114, 112 (see, e.g., FIG. 8). In some implementations, the spatula 160 may comprise a handle 162 configured to be grasp by the fingers of a user and a broad, flat blade 164 suitable for spreading a portion of the cosmetic formula 166. In some implementations, the spatula 160 may be made of plastic. In some implementations, the spatula 160 may be made of any material suitable for extracting and/or spreading the cosmetic formula 166.

Figure 6:
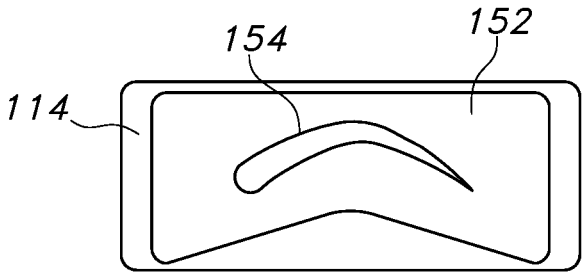
FIGS. 6-8 illustrate an example method of using the cosmetic eyebrow kit to deposit a cosmetic eyebrow on a brow applicator.
Figure 8:
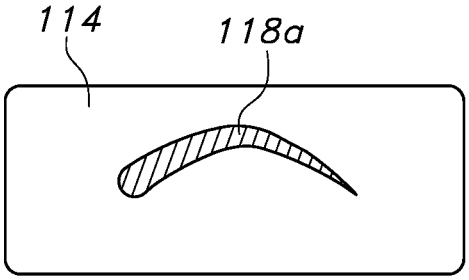

FIGS. 6-8 illustrate an example method of using a cosmetic eyebrow kit 150 to deposit a cosmetic eyebrow 118*a*, 118*b* on a first brow applicator 114 and a second brow applicator 112.

Initially, as shown in FIG. 6, in some implementations, the eyebrow stencil 152 may be positioned on a first side of a first brow applicator 114 so that the eyebrow aperture 154 is oriented to form a first cosmetic eyebrow 118*a* (e.g., a cosmetic eyebrow that is oriented for use above the right eye of a user).

Then, in some implementations, the spatula 160 may be used to extract a portion of the selected cosmetic formula 166. The user may, for example, select any suitable cosmetic formula 166 having the desired color.

Next, as shown in FIG. 7, in some implementations, the spatula 160 may be used to fill the aperture 154 of the eyebrow stencil 152 by spreading a portion of the selected cosmetic formula 166 therein. In this way, a portion of the cosmetic formula 166 is deposited on the portion of the first brow applicator 114 that is exposed within the aperture 154 of the eyebrow stencil 152.

Then, as shown in FIG. 8, in some implementations, the eyebrow stencil 152 may be removed from the first brow applicator 114 thereby exposing the newly deposited cosmetic eyebrow 118*a*.

Prior to using the same eyebrow stencil 152 to deposit a second cosmetic eyebrow 118*b* onto the second brow applicator 112, in some implementations, the eyebrow stencil 154 may be cleaned. In this way, any cosmetic formula 166 left on the eyebrow stencil 152 from its first use will not be inadvertently transferred to the second brow applicator 112. In some implementations, this step may not be required if two or more eyebrow stencils 152 were provided as part of a cosmetic eyebrow kit 150.

Next, in some implementations, the eyebrow stencil 152 may be positioned on a first side of a second brow applicator 112 so that the eyebrow aperture 154 is oriented to form a second cosmetic eyebrow 118*b* (e.g., a cosmetic eyebrow that is oriented for use above the left eye of a user).

Then, in some implementations, the spatula 160 may be used to extract a portion of the selected cosmetic formula 166. The user may, for example, select any suitable cosmetic formula 166 having the desired color.

Next, in some implementations, the spatula 160 may be used to fill the aperture 154 of the eyebrow stencil 152 by spreading a portion of the selected cosmetic formula 166 therein. In this way, a portion of the cosmetic formula 166 is deposited on the portion of the second brow applicator 112 that is exposed within the aperture 154 of the eyebrow stencil 152.

Then, in some implementations, the eyebrow stencil 152 may be removed from the second brow applicator 112 thereby exposing the newly deposited cosmetic eyebrow 118*b*.

Either of the eyebrow applicators 114, 112 may now be used to apply a cosmetic eyebrow on the appropriate brow ridge of a user and/or stored for later use.

As shown in FIG. 5, in some implementations, the cosmetic eyebrow kit 150 may further comprise a core ply 116. In this way, after a cosmetic eyebrow 118*a*, 118*b* has been deposited on a brow applicator 114, 112 by the user, the first brow applicator 114 and/or the second brow applicator 112 may be removably secured to the first side 117*a* and the second side 117*b*, respectively, of the core ply 116 for storage and later use.

As shown in FIG. 5, in some implementations, the cosmetic eyebrow kit 150 may further comprise a brush 170. In some implementations, the brush 170 may be used to blend in the cosmetic eyebrow 118*a*, 118*b* with the eyebrow hairs on the user's brow ridge. In this way, a more natural look may be achieved.

Reference throughout this specification to "an embodiment" or "an implementation" or words of similar import means that a particular described feature, structure, or characteristic is included in at least one embodiment of the present invention. Thus, the phrase "in an embodiment" or "an implementation" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A method of using a cosmetic eyebrow kit, the method comprising:

providing a cosmetic eyebrow kit that comprises: a first brow applicator made of a clear polymer film; an eyebrow stencil having an eyebrow shaped aperture that extends therethrough; a cosmetic formula; a spatula configured to spread the cosmetic formula; and a core ply having a first side, a second side, and a centrally positioned aperture that extends therethrough;

positioning the eyebrow stencil on a side of the first brow applicator so that the eyebrow stencil is oriented to form a first cosmetic eyebrow;

using the spatula to deposit a portion of the cosmetic formula within the eyebrow shaped aperture of the eyebrow stencil;

filling in the eyebrow shaped aperture of the eyebrow stencil using the spatula to spread the portion of cosmetic formula deposited therein;

removing the eyebrow stencil from the first brow applicator to thereby expose a first cosmetic eyebrow that has been deposited thereon; and securing the first brow applicator to the first side of the core ply using an adhesive, the first brow applicator is oriented to place the cosmetic eyebrow thereon within the centrally positioned aperture of the core ply.

2. The method of claim 1, wherein the adhesive securing the first brow applicator to the first side of the core ply is a pressure sensitive adhesive.

3. A cosmetic eyebrow kit comprising:

a first brow applicator made of a clear polymer film;

a second brow applicator made of a clear polymer film;

an eyebrow stencil made of a polymer film, the eyebrow stencil includes an eyebrow shaped aperture that extends therethrough;

a container of cosmetic formula;

a spatula having a handle and a blade, the spatula is configured to spread the cosmetic formula; and a core ply having a first side, a second side, and a centrally positioned aperture that extends therethrough;

wherein a first portion of the cosmetic formula can be deposited onto the first brow applicator in the shape of an eyebrow through the use of the eyebrow stencil and the spatula;

wherein a second portion of the cosmetic formula can be deposited onto the second brow applicator in the shape of an eyebrow through the use of the eyebrow stencil and the spatula;

wherein pressure sensitive adhesive is used to removably secure the first brow applicator and the second brow applicator to the first side and the second side of the core ply, respectively.

4. A method of using a cosmetic eyebrow kit, the method comprising:

providing a cosmetic eyebrow kit that comprises: first brow applicator made of a clear polymer film; a second brow applicator made of a clear polymer film; an eyebrow stencil having an eyebrow shaped aperture that extends therethrough; a cosmetic formula; a spatula configured to spread the cosmetic formula; and a core ply having a first side, a second side, and a centrally positioned aperture that extends therethrough;

positioning the eyebrow stencil on a side of the first brow applicator so that the eyebrow stencil is oriented to form a first cosmetic eyebrow;

using the spatula to deposit a portion of the cosmetic formula within the eyebrow shaped aperture of the eyebrow stencil;

filling in the eyebrow shaped aperture of the eyebrow stencil using the spatula to spread the portion of cosmetic formula deposited therein;

removing the eyebrow stencil from the first brow applicator to thereby expose a first cosmetic eyebrow that has been deposited thereon;

positioning the eyebrow stencil on a side of the second brow applicator so that the eyebrow stencil is oriented to form a second cosmetic eyebrow;

using the spatula to deposit a portion of the cosmetic formula within the eyebrow shaped aperture of the eyebrow stencil;

filling in the eyebrow shaped aperture of the eyebrow stencil using the spatula to spread the portion of cosmetic formula deposited therein;

removing the eyebrow stencil from the second brow applicator to thereby expose a second cosmetic eyebrow that has been deposited thereon;

securing the first brow applicator to the first side of the core ply using an adhesive, the first brow applicator is oriented to place the cosmetic eyebrow thereon within the centrally positioned aperture of the core ply; and securing the second brow applicator to the second side of the core ply using an adhesive, the second brow applicator is oriented to place the cosmetic eyebrow thereon within the centrally positioned aperture of the core ply.

5. The method of claim 4 wherein the adhesive securing the first brow applicator and the second brow applicator to the first side and the second side of the core ply, respectively, is a pressure sensitive adhesive.

* * * * *